US006745474B1

(12) United States Patent
Huang

(10) Patent No.: US 6,745,474 B1
(45) Date of Patent: Jun. 8, 2004

(54) BLADE PUSHING DEVICE OF CUTTING KNIVES

(76) Inventor: Chien Kai Huang, No. 136, Tsu Chiang Road, Chang Hua City (TW)

( * ) Notice: Subject to any disclaimer, the term of this patent is extended or adjusted under 35 U.S.C. 154(b) by 35 days.

(21) Appl. No.: 10/320,444

(22) Filed: Dec. 17, 2002

(51) Int. Cl.[7] ..... B26B 1/08
(52) U.S. Cl. ..... 30/162; 30/335
(58) Field of Search ..... 30/162, 335, 151, 30/329, 125

(56) References Cited

U.S. PATENT DOCUMENTS 2,722,914 A * 11/1955 Aversa ..... 30/162 X
3,863,339 A * 2/1975 Reaney et al. ..... 30/162
4,103,421 A * 8/1978 Quenot ..... 30/162
4,170,062 A * 10/1979 Machida ..... 30/162
4,322,885 A * 4/1982 Osada ..... 30/162
4,558,517 A * 12/1985 Gringer ..... 30/162 X
5,269,063 A * 12/1993 Okada ..... 30/162
5,502,896 A * 4/1996 Chen ..... 30/162
5,531,754 A * 7/1996 Shackelford et al. ..... 30/162 X
5,774,994 A * 7/1998 Stein et al. ..... 30/162 X
6,006,433 A * 12/1999 Baltazar ..... 30/162
6,226,873 B1 * 5/2001 Okumura ..... 30/162
6,254,621 B1 * 7/2001 Shackelford et al. ..... 30/162 X

* cited by examiner

*Primary Examiner*—Charles Goodman
(74) *Attorney, Agent, or Firm*—Rosenberg, Klein & Lee

(57) ABSTRACT

A cutting knife includes a holder with a slot defined in a side thereof and a plurality of recesses defined in one of two sides of the slot. A base member is slidably engaged with the slot and a blade is connected to the base member. The base member has a wall in which a spring member is received. The spring member includes a protrusion which extends through an opening defined in the wall and is engaged with one of the recesses. A spring is biased between an inside of the wall and a reverse side of the protrusion of the spring member so as to provide a force to engage the protrusion in the recess. Two end portions of the spring member contact against the insides of the wall. An operation member is slidably mounted to the wall and includes a wedge-shaped notch which may push the protrusion downward to disengage from the recess.

1 Claim, 7 Drawing Sheets

BLADE PUSHING DEVICE OF CUTTING KNIVES

FIELD OF THE INVENTION

The present invention relates to a blade pushing device of a cutting knife wherein the spring member has two ends contacting against two insides of the body member so as to prevent the spring member from being fatigue fast.

BACKGROUND OF THE INVENTION

A conventional cutting knife 10 is shown in FIGS. 1 and 2 and in U.S. Pat. No. 6,226,873. A slider 13 is slidably engaged with the slot 111 of the holder 11. A blade 12 is connected to the base plate, of the slider 13 and a leaf spring 133 is received in a chamber 131 A of a body member 131 of the slider 13. The leaf spring 133 includes a protrusion 133A that retractably extends through a notch of the body member 131 so as to be engaged with one of the recesses 111A defined in the inside of the slot 111. An operation member 132 is movably mounted to the body member 131 and has a wedge-shaped notch 132A which may push the protrusion 133A of the leaf spring 133 downward to disengage the protrusion 133A from the recess 111A so that the blade 12 can be moved till the protrusion 133A is engaged with another recess 111A. The two ends of the leaf spring 133 have no stop means to limit their deformation and shifting so that the deformation of the leaf spring 133 is not under control and this makes the leaf spring 133 to reach its limitation of fatigue more quickly than expected.

The present invention intends to provide an improved blade pushing device for a cutting knife and the two ends of the spring member are stopped by two insides of the body such that the deformation of the spring member can be well controlled.

SUMMARY OF THE INVENTION

The primary object of the present invention is to provide a cutting knife that has a spring member received in a base member which is slidably engaged with the slot in the holder, a spring is biased between an inside of the wall and the reverse side of the protrusion of the spring member so as to provide a force to engage the protrusions with one of the recesses defined in one of two sides of the slot.

Another object of the present invention is to provide a cutting knife wherein the spring member has two end portions which contact against the insides of the wall so as to limit the deformation n of the spring member when the protrusion of the spring member is pushed to disengage from the opening of the wall of the base member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
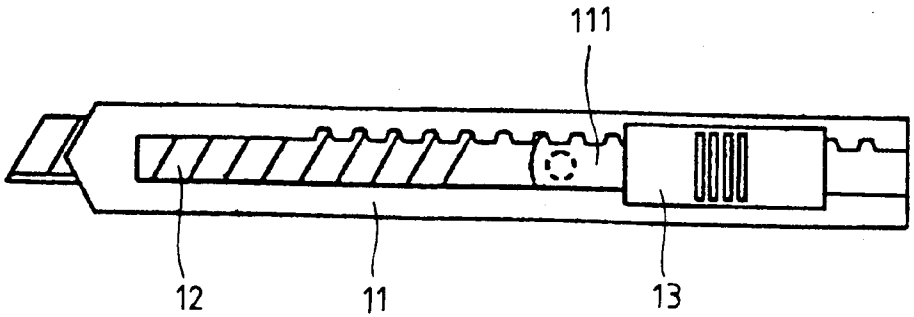
FIG. 1 PRIOR ART
FIG. 1 is a side view to show a conventional cutting knife.
Figure 2:
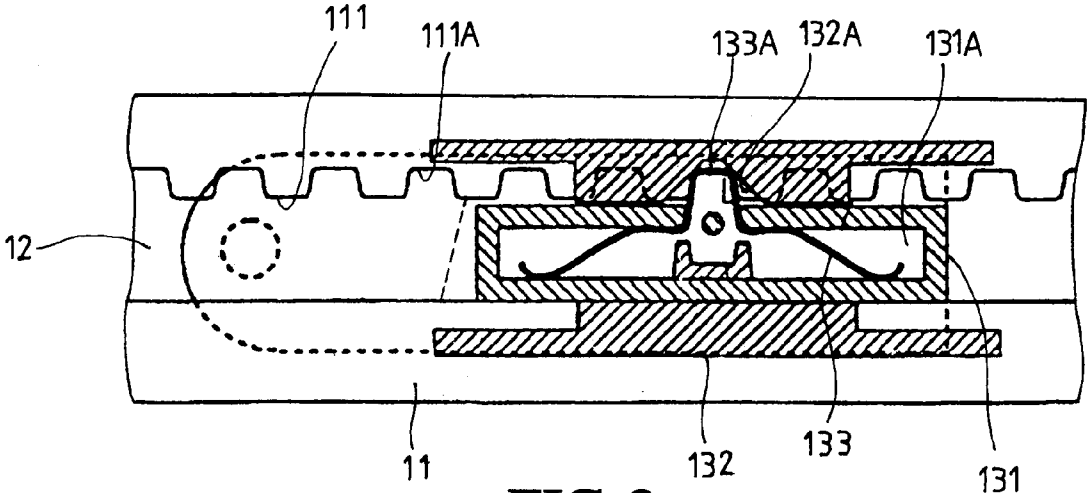
FIG. 2 PRIOR ART
FIG. 2 is a cross sectional view to show the conventional pushing device of the conventional cutting knife.
Figure 3:
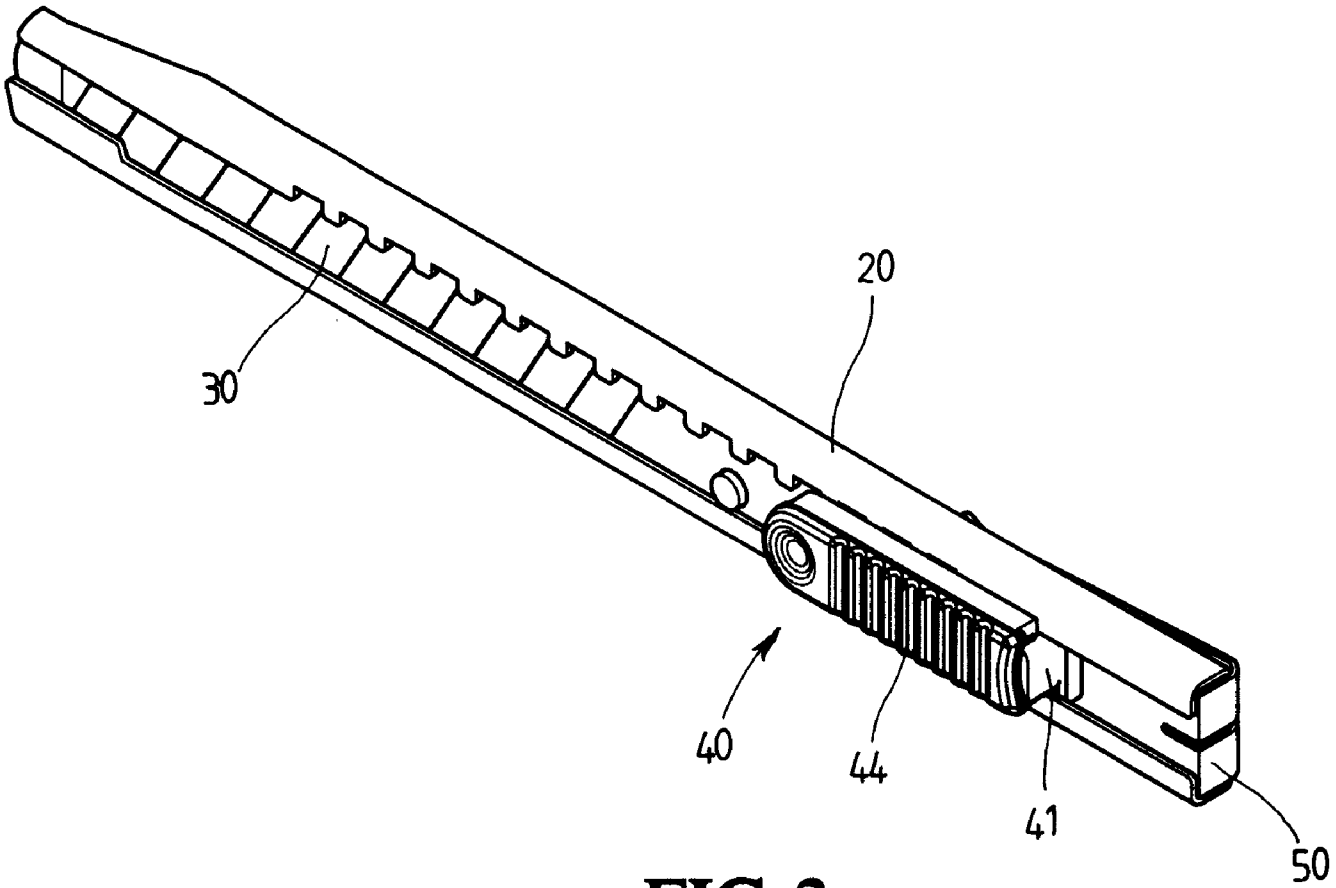
FIG. 3 is a perspective view to show the cutting knife of the present invention.
Figure 4:
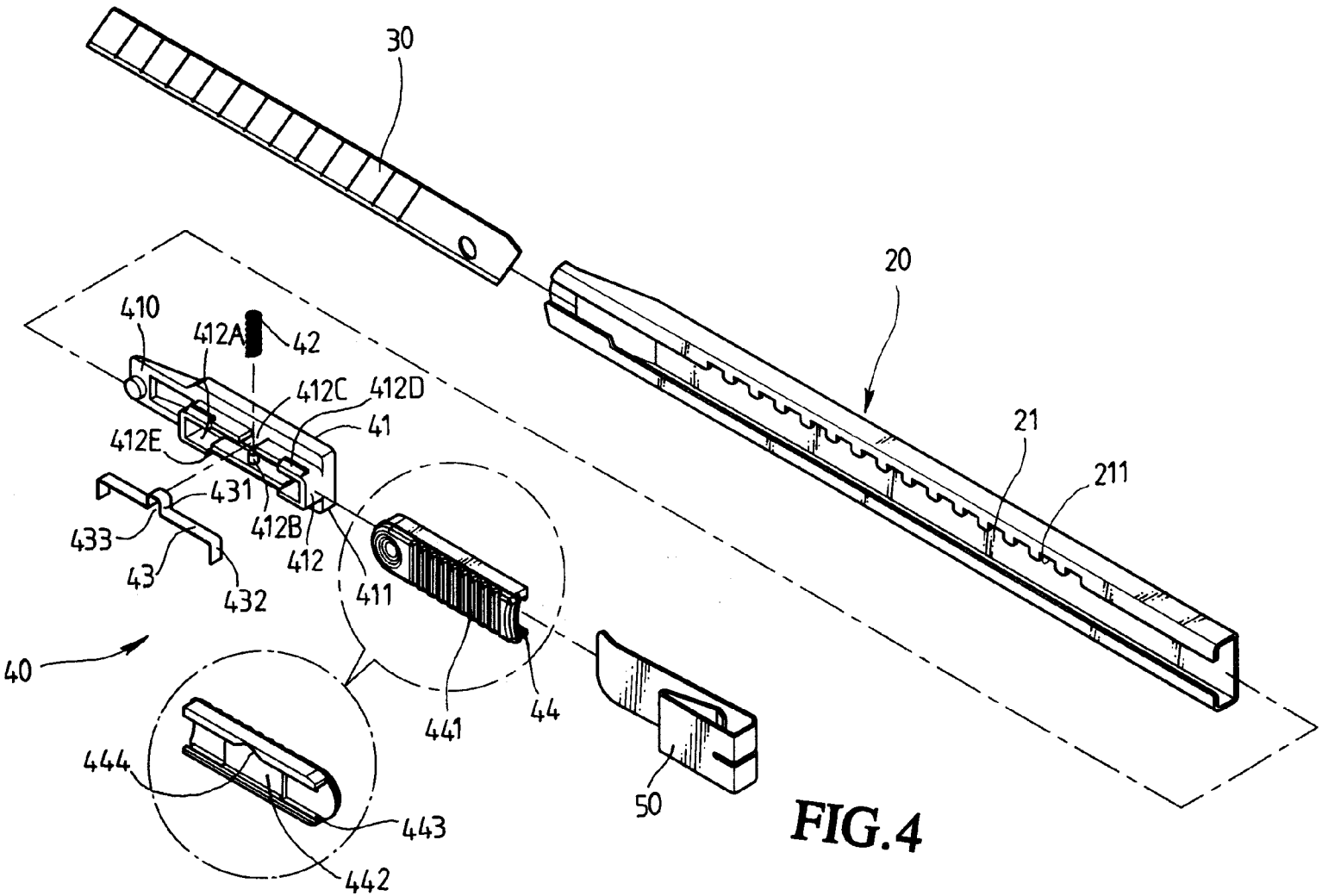
FIG. 4 is an exploded view to show the cutting knife of the present invention.
Figure 5A:
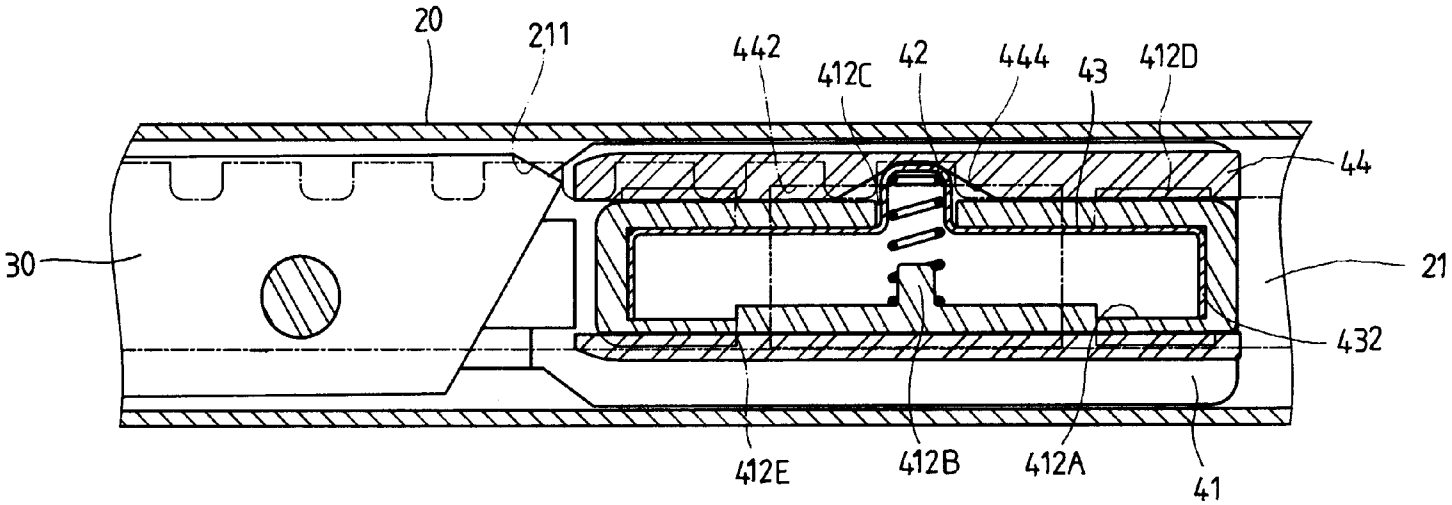
FIG. 5A shows the protrusion of the spring member is engaged with a recess of the slot.
Figure 5B:
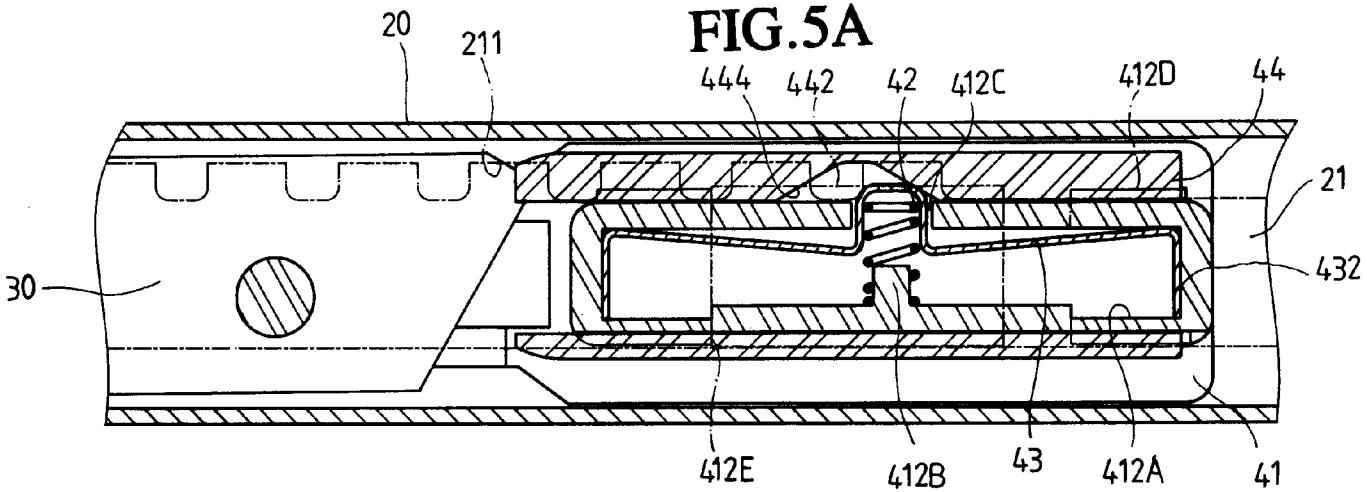
FIG. 5B shows the operation member is pushed to push the protrusion off from the recess.
Figure 5C:
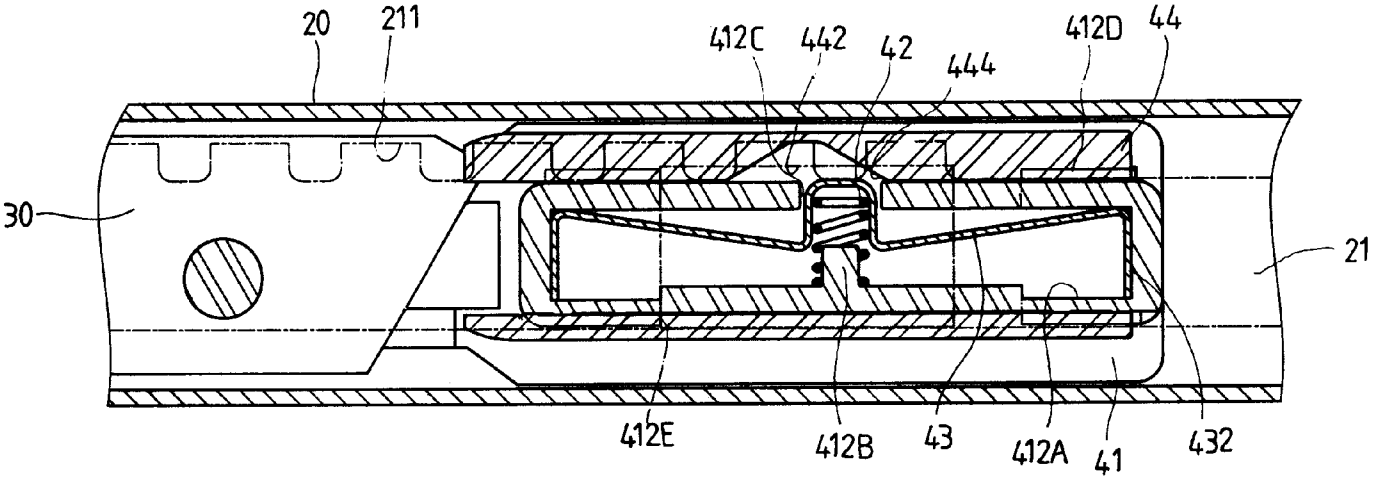
FIG. 5C shows the protrusion is completely disengaged from the recess.
Figure 5D:
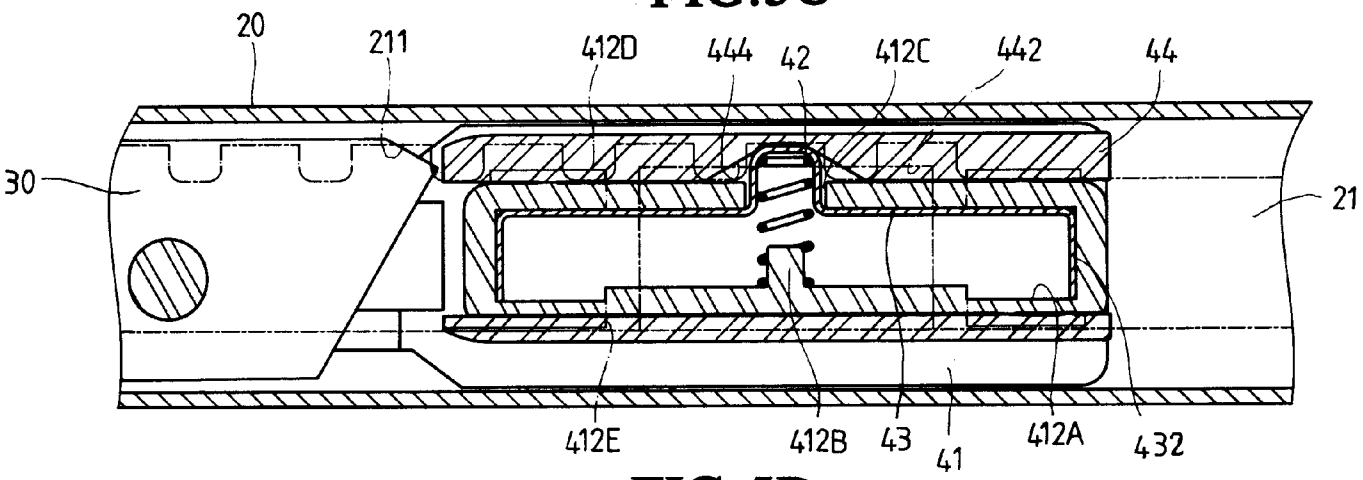
FIG. 5D shows the protrusion is engaged with another recess.

Referring to FIGS. 3, 4 and 5A, the cutting knife of the present invention comprises a holder 20 having a slot 21 defined in a side thereof and a plurality of recesses 211 are defined in one of two sides defining the slot 21. An end piece 50 is engaged with an opening at one end of the holder 20 and a blade 30 is movably inserted in the holder 20 via the other opening at the other end of the holder 20.

A pushing assembly 40 includes a base member 41 which is slidably received in the slot 21 by engaging two side flanges 411 with the slot 21. A plate 410 extends from a front end of the base member 41 and a boss extends from a side of the plate 410 so as to be engaged with a hole defined through the blade 30. A wall 412 extends from a side of the base member 40 and an opening 412C is defined through the wall 412. A rod 412B extends from an inside of the wall 412 and a first end of a spring 42 is mounted to the rod 412B. Two stops 412E extend from an edge of the wall 412 and located at two ends of the wall 412.

A spring member 43 is received in a space 412A enclosed by the wall 412 and has a protrusion 431 engaged with the opening 412C in the wall 412. A second end of the spring 42 contacts a reverse, side 433 of the protrusion 421 of the spring member 43. The protrusion 431 of the spring member 43 is pushed by the spring 42 and engaged with one of the recesses 211 of the slot 21 of the holder 20. Two end portions 432 extend from two ends of a main portion of the spring member 43 and contact against two insides of the wall 412.

Figure 6A:
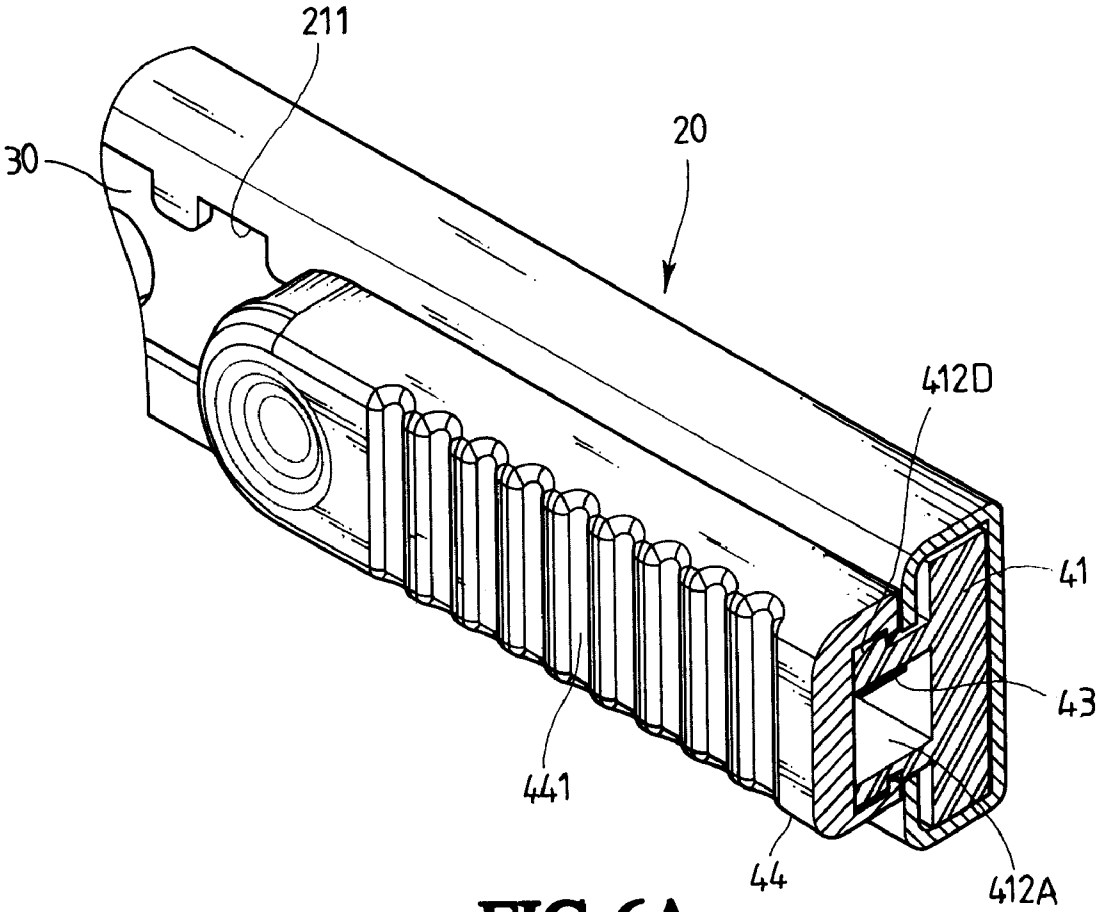
FIG. 6A shows the operation member has two rails slidably mounted to the grooves of the wall on the base member.
Figure 6B:
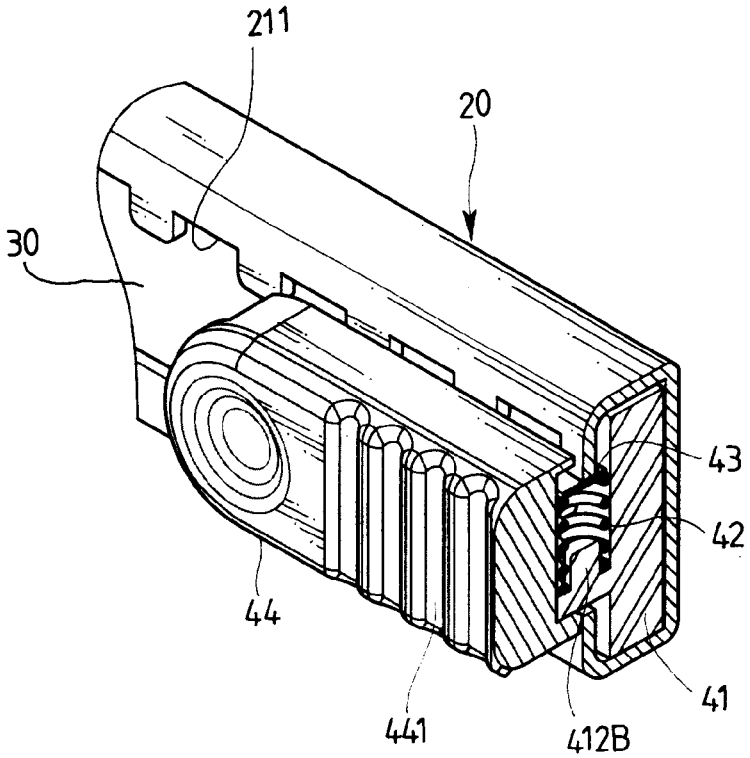
FIG. 6B is an end cross sectional view to show the protrusion is engaged with a recess.
Figure 6C:
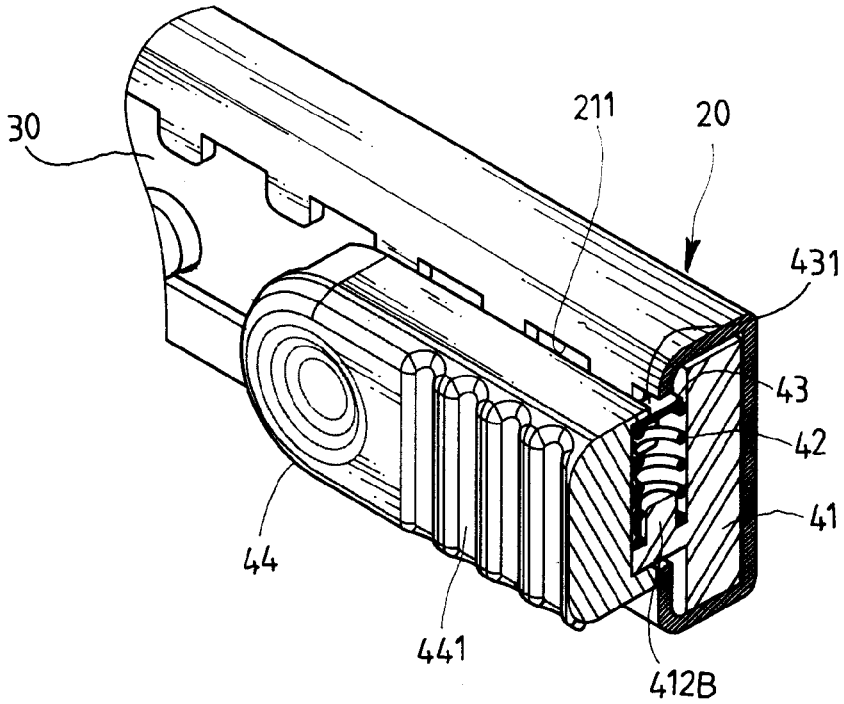
FIG. 6C shows the protrusion is pushed by moving the operation member.

Further referring to FIG. 6A, an operation member 44 has two side walls and each of the side walls has a rail 443 which is slidably engaged with grooves 412D defined in the outside of the wall 412 so that the operation member 44 is movably mounted to the outside of the wall 412 by pushing a rough surface 441 on the top surface of the operation member 44. A convex portion 442 extends from an inside of the operation member 44 and two ends of the convex portion 442 are movable between the two stops 412E on the wall 412. A wedge-shaped notch 444 is defined in a side of the operation member 44 and the protrusion 431 of the spring member 43 is engaged with the wedge-shaped notch 444.

Referring to FIGS. 5B to 5D, 6B and 6C, when pushing the operation member 44 toward the blade 30, the protrusion 431 is pushed downward by the side of the wedge-shaped notch 444 so that the spring member 43 is deformed and the protrusion 431 is disengaged from the recess 211. The operation member 44 can then be pushed with the blade 30 while holding the position of the operation member 44 relative to the protrusion 431 of the spring member 43, till a desired position, the protrusion 431 is biased to engage with another recess 211.

The two end portions 432 are supported by the insides of the wall 412 so that the spring member 43 will not be deformed too much and this may prevent the spring member 43 from reaching its point of fatigue too fast. Besides, the spring 42 provides a firm engagement of the protrusion 431 and the recess 211 such that the blade 30 can be fixed relative to the holder 20 when using the blade 30 to cut a stiff object.

While we have shown and described the embodiment in accordance with the present invention, it should be clear to those skilled in the art that further embodiments may be made without departing from the scope of the present invention.

What is claimed is:

1. A cutting knife comprising:

a holder having a slot defined in a side thereof and a plurality of recesses defined in one of two sides defining the slot;

a base member slidably received in the slot and having a plate extending from a front end thereof, a boss extending from a side of the plate and a blade received in the slot and engaged with the boss, a wall extending from a side of the base member and an opening defined through the wall, a rod extending from an inside of the wall and a first end of a spring mounted to the rod, two stops extending from an edge of the wall;

a spring member having a protrusion engaged with the opening in the wall and a second end of the spring contacting a reverse side of the protrusion of the spring member, the protrusion of the spring member engaged with one of the recesses of the slot of the holder, two end portions extending from a main portion of the spring member and contacting against two insides of the wall, and an operation member movably mounted to an outside of the wall and a convex portion extending from an inside of the operation member, two ends of the convex portion being movable between the two stops on the wall, a wedge-shaped notch defined in a side of the opt ration member and the protrusion of the spring member engaged with the wedge-shaped notch.

* * * * *